US006527543B2

(12) United States Patent
Tsai

(10) Patent No.: US 6,527,543 B2
(45) Date of Patent: Mar. 4, 2003

(54) SAFETY CATCH DEVICE FOR A GAS BURNER

(76) Inventor: Chin-Lin Tsai, No. 94, Sec. 4, Chung Hsin Road, San Chung City, Taipei Hsien (TW)

( * ) Notice: Subject to any disclaimer, the term of this patent is extended or adjusted under 35 U.S.C. 154(b) by 0 days.

(21) Appl. No.: 09/919,929

(22) Filed: Aug. 2, 2001

(65) Prior Publication Data

US 2003/0008254 A1 Jan. 9, 2003

(30) Foreign Application Priority Data

Jul. 3, 2001 (TW) ..... 90211172 U

(51) Int. Cl.[7] ..... F23D 11/36
(52) U.S. Cl. ..... 431/153; 431/255; 431/344
(58) Field of Search ..... 431/153, 255, 431/344, 345; 126/406, 407, 408, 409, 413, 414

(56) References Cited

U.S. PATENT DOCUMENTS 5,564,919 A * 10/1996 Tsai ..... 431/255
5,647,738 A * 7/1997 Tsai ..... 431/255
6,065,959 A * 5/2000 Tsai ..... 431/255
6,196,833 B1 * 3/2001 Ho ..... 431/153
6,293,782 B1 * 9/2001 Tsai ..... 431/153

* cited by examiner

*Primary Examiner*—James C. Yeung
(74) *Attorney, Agent, or Firm*—Troxell Law Office PLLC

(57) ABSTRACT

A safety catch device for a gas burner comprises a press part, and a catch part. The press part has a shape of key and is disposed at a front side of a casing of the gas burner. The press part further provides a press chamber with an opening facing backward, and a lateral wall thereof is against a piezo-electric apparatus. Another wall of the press chamber extends a press stem backward. The catch part has a shape of key too and is mounted on the casing opposite to the press part. The catch part provides a push key extending outside the casing and the push key at the front side thereof has a step seat with the top thereof providing a locating hole for receiving an extension spring. The extension spring at the end in the locating hole presses against the inner wall of the casing and the step seat extends laterally a protrusion against the press stem. As soon as the catch part is pressed upward to compress the extension spring, the protrusion is separate from the press stem and the press button is pressed down such that the press chamber and the lateral wall thereof squeezes a control valve in a gas supply device of the gas burner and the piezo-electric apparatus respectively so as to admit the gas through control valve. Hence, the gas can be ignited by way of a spark generated from the piezo-electric apparatus in case of the protrusion being supported by the press stem to keep the catch part from moving downward.

8 Claims, 6 Drawing Sheets

SAFETY CATCH DEVICE FOR A GAS BURNER

BACKGROUND OF THE INVENTION

1. Field of the Invention

The present invention relates to a safety catch device for a gas burner, and particularly to a safety catch device that prevents a gas burner from being carelessly used by children.

2. Description of Related Art

Due to a change of times, the burner has become a major device for making fire. A daily used burner, taking the gas heater as an example, provides advantages such as strong flames single hand operation, and convenient portability so that the burner is loved and popularly used by us.

Because the healing torch is quite popularly used. it is often that the heating torch is thoughtlessly left around, making it possible for children to reach it easily Due to the imitation and the curiosity frequently exhibited during childhood, a child may easily play the heating torch himself as soon as he gets it. However, it is very easy to catch fire caused by the carelessness during the child playing the heating torch, and the fire resulting from careless play of the child may greatly endanger our lives and the security of our properties. It is found that the conventional safety switch on the heating torch is easily released giving children a chance to play with it freely. Consequently, it leads to an unexpected accident.

In order to prevent tragedy originating from children playing with fire, the United States and the European countries have required that a safety device has to be equipped with the burner. The U.S. Pat. Nos. 5,460,521 and 5,741,128 owned by the present inventor are typical examples of safety devices suitable for a burner respectively That is, the burner with a safety device of either U.S. Pat. No. 5,460,521 or U.S. Pat. No. 5,741,128 is locked before the burner can be used and it can be used after the safety device has been released. Due to increasing the difficulty of operation, it is not possible for children to ignite the fire while playing with the burner such as the heater torch so that it is possible to reduce the occurrence of disaster.

Further, the present inventor has filed a U.S. patent application Ser. No. 09/639,845, now U.S. Pat. No. 6,293,782, and Taiwanese Patent Application No. 89213608, which is identical with U.S. Patent Application, has been granted gives the present inventor a greater encouragement to develop the present invention.

SUMMARY OF THE INVENTION

An object of the present invention is to provide a safety catch device for a gas burner, in which an engaging part and a press part are arranged to constitute a double reliable switch such that the operation of the burner becomes very complicated in construction and very difficult to be operated for preventing an unexpected fatality derived from the careless play conducted by children.

BRIEF DESCRIPTION OF THE DRAWINGS

The present invention can be more fully understood by referencing to the following detailed description and accompanying drawings, in which.

DETAILED DESCRIPTION OF THE PREFERRED EMBODIMENTS

Figure 1:
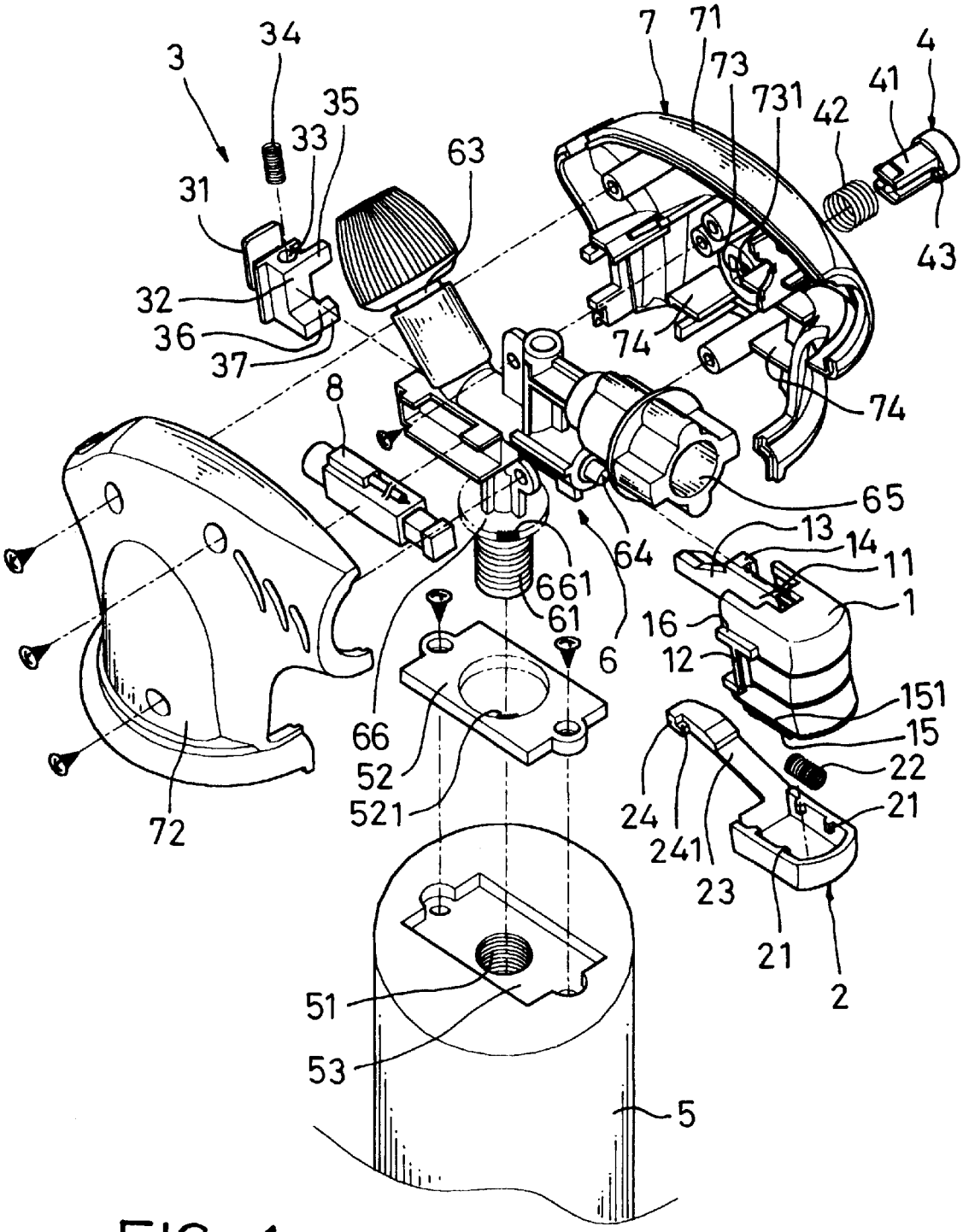
FIG. 1 is an exploded perspective view of a safety catch device for a gas burner according to the present invention.
Figure 2:
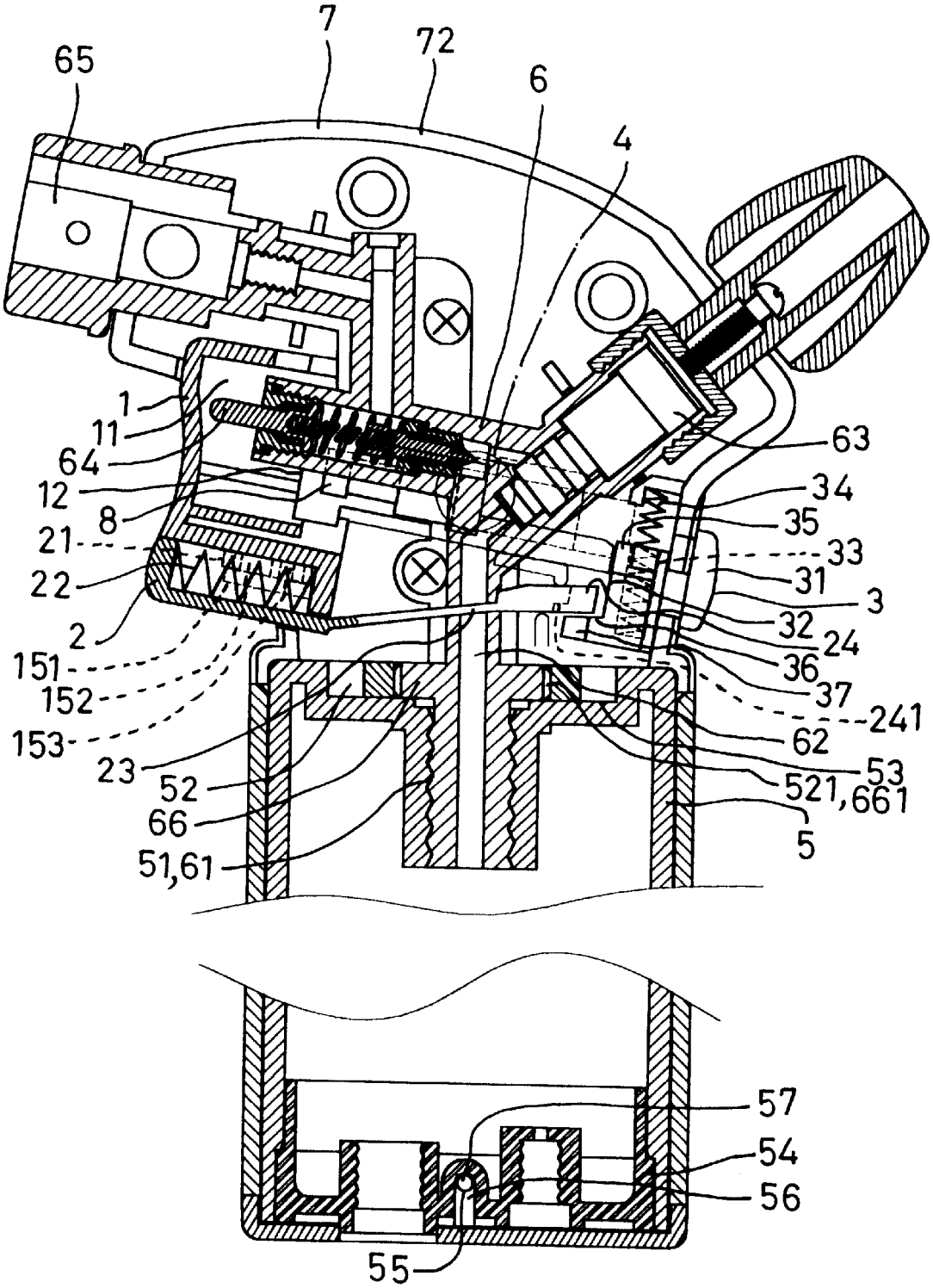
FIG. 2 is a sectional view of FIG. 1 after the components thereof being assembled.
Figure 3:
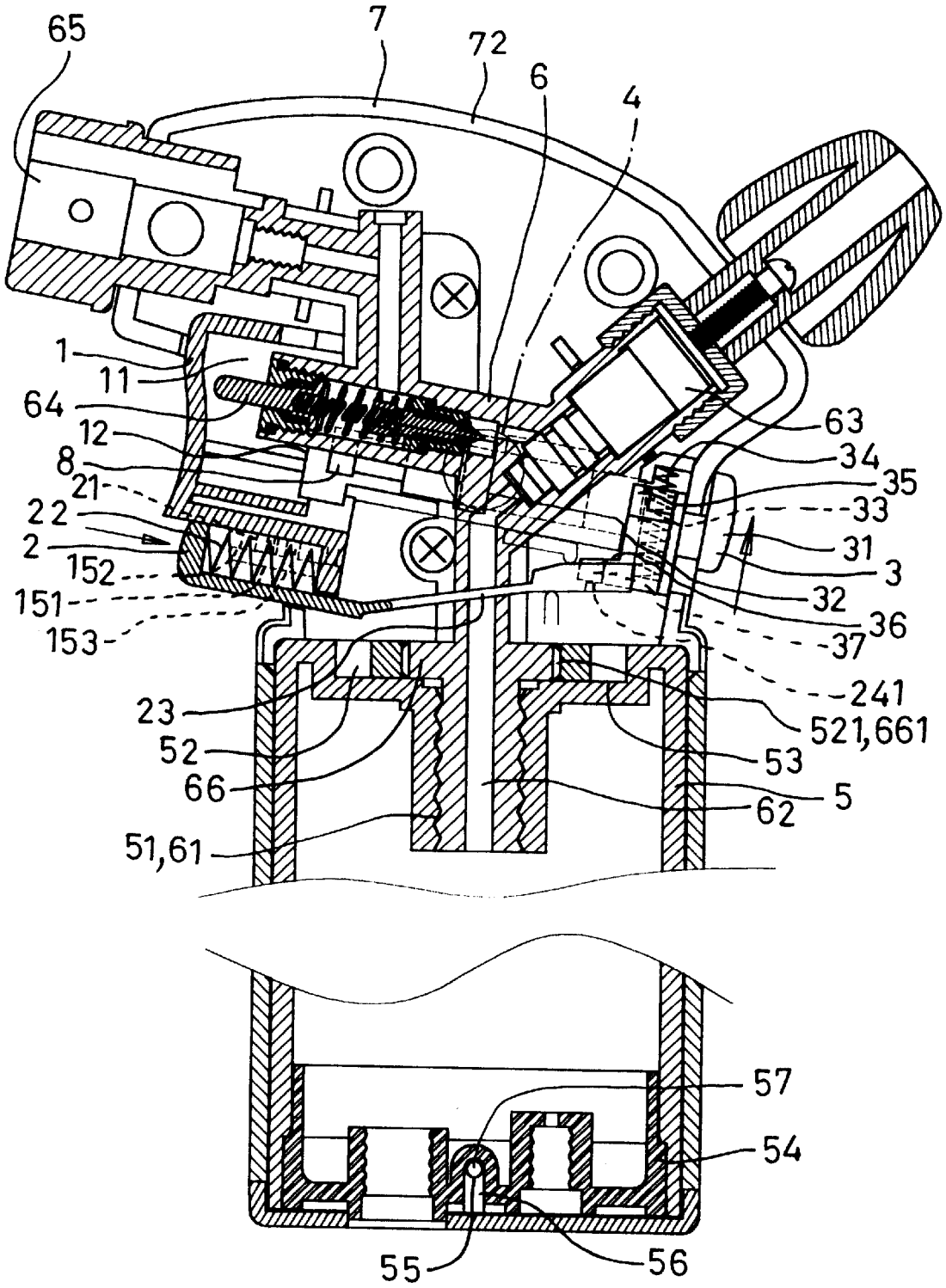
FIGS. 3 and 4 are section views similar to FIG. 2 illustrating steps with regard to release the safety catch device for a gas burner of the present invention from the state of locking.
Figure 4:
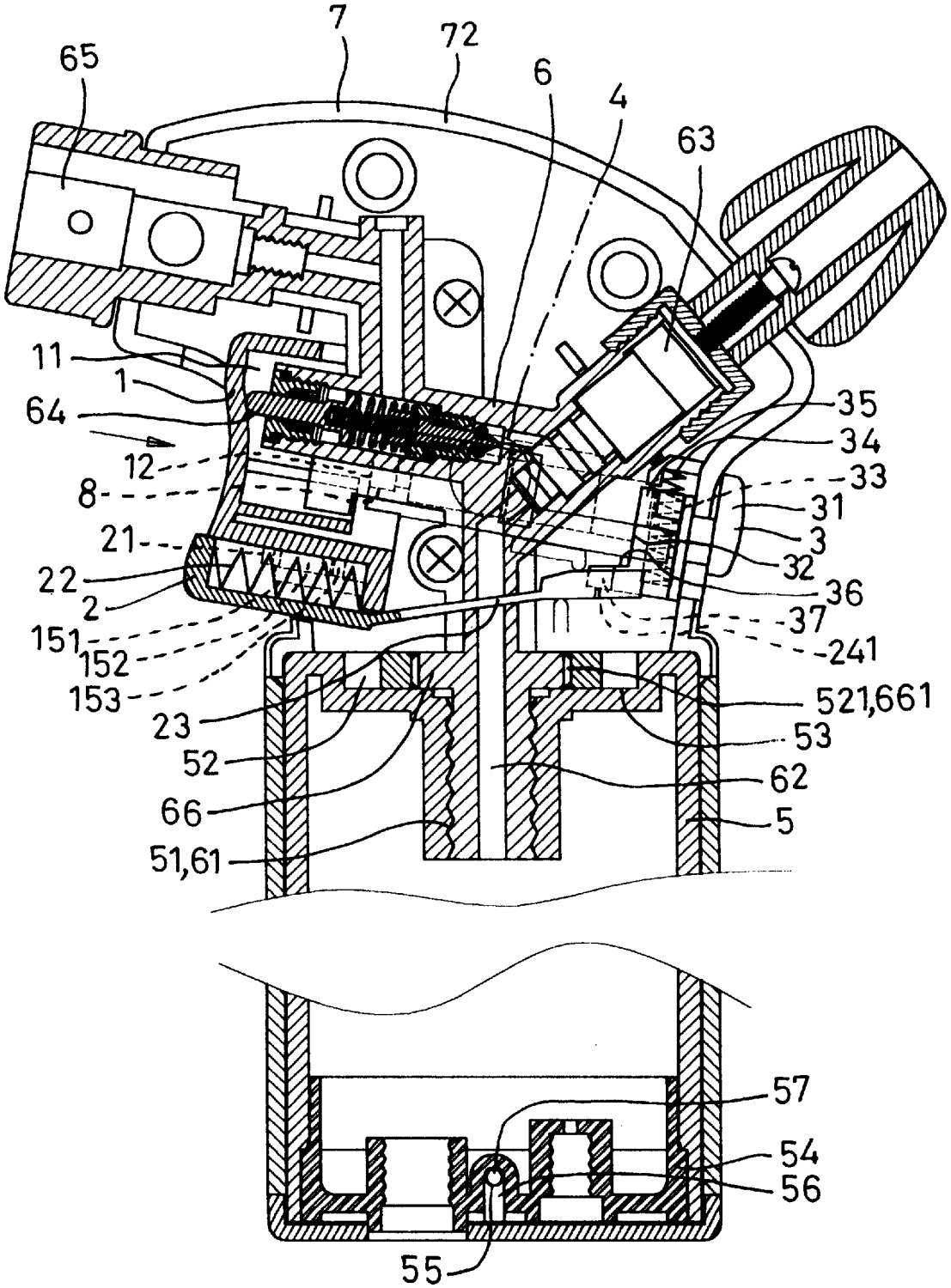
Figure 5:
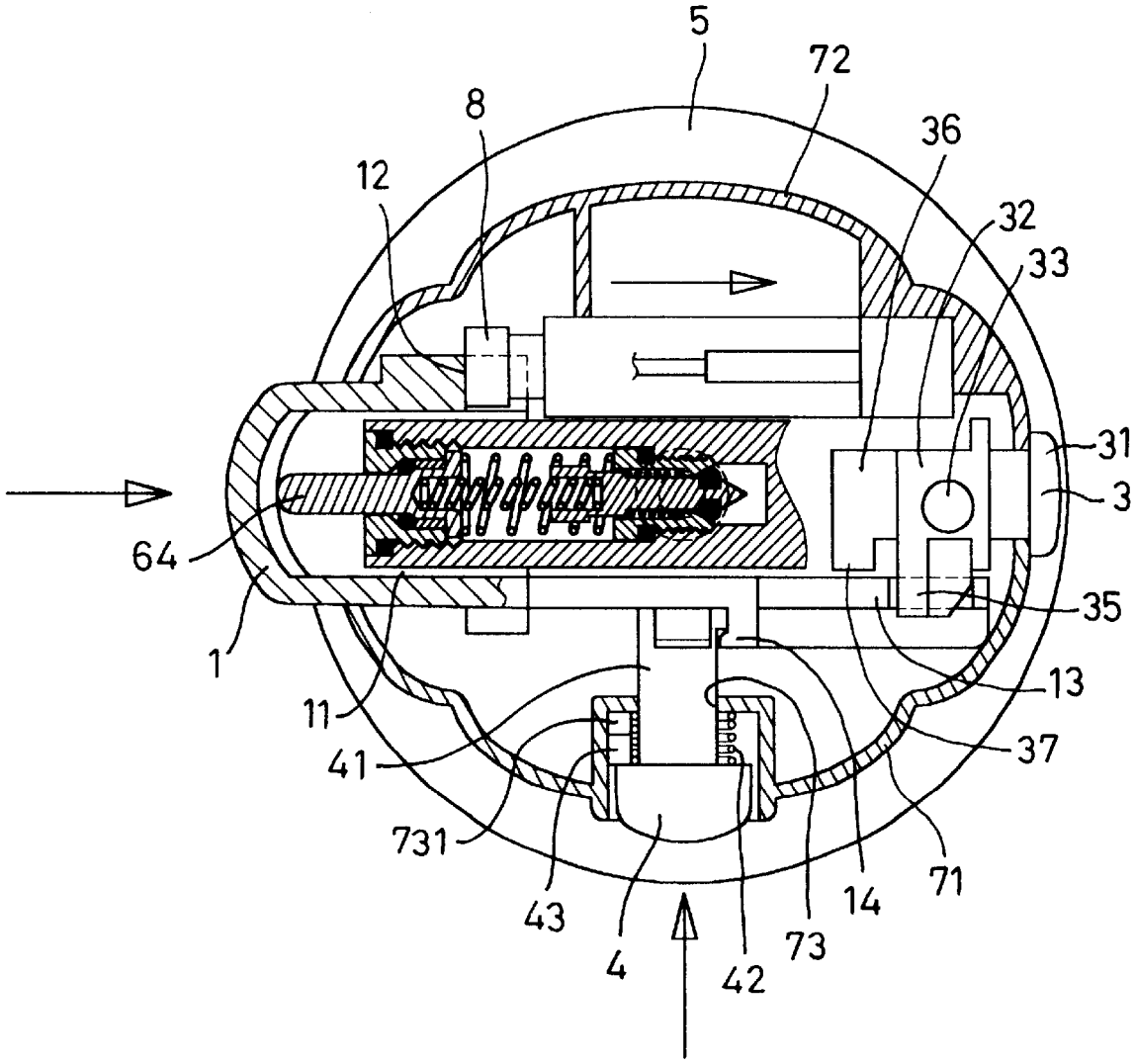
FIG. 5 is a top sectional view illustrating a press part, a press button, and a catch part in the safety catch device for a gas burner of the present invention being in a state of locking.

Referring to FIGS. 1 and 2, a safety catch device for a gas burner according to the present invention basically comprises a press part 1, an engaging part 2, a catch part 3 and a press button 4. The safety catch device is disposed above a storage barrel 5 next to a gas supply device 6, and it is covered with a casing 7.

Wherein, the press part 1 provides a shape of key and has a press chamber 11 at the front side thereof with an opening facing the back thereof. The press chamber 11 receives an extensible control valve 64 and a press tenon 12 at a lateral wall of the press chamber 11 is disposed against a piezoelectric apparatus 8. A press stem 13 extends rearward from another lateral wall of the press part 1 and an outer end of the press stem 13 is in a state of resisting the catch part 3 before operation so that the press part 1 is not possible to be pushed backward. Besides, the press stem 13 has a lateral engaging projection 14 to engage with the press button 4 so that the press button can be in a locked state. Moreover, a fixing base 15 at the bottom of the press part 1 provides a slide rail 151 at both lateral sides thereof respectively and forms a rail groove 152 with a rail tenon 153 vertically extending from the rail groove 152 such that the engaging part 2 can displace along with the press part 1. In order to move smoothly in the casing 7, the press part 1 at both lateral walls thereof may protrude a plurality of slide projections 16 respectively to lap over a rib plate 74 on the inner wall of the casing 7.

The engaging part 2 is a lid with an opening top and two opposite walls of the opening top provide two lateral projections 21 respectively corresponding to the rail groove 152 for engaging with the rail groove 152 so that the respective rail projection 153 can be disposed between the two lateral projections 21. A spring 22 is mounted between the front inner wall of the engaging part 2 and the fixing base 15 such that the engaging part 2 can move back and forth on the fixing base 15 and can be restored to the original position thereof. Besides, the engaging part 2 extends backward a tilt lock plate 23 with respect to a lateral wall of the press stem 13 and an end of the engaging part 2 projects inward a lock hook 24 with a hook recess 241 to move relative to a plate tenon 37 on the catch part 3. In case of the hook plate 23 being in a state of lap joining with the plate tenon 37, the catch part 3 is resisted from pushing upward before operation and in case of the hook plate moving backward and being in a state of separating from the plate tenon 37, the catch part 3 is admitted to push upward.

The catch part 3 also provides a shape of key and is disposed in the casing 7 behind the press stem 13 and the lock plate 23. A push key 31 of the catch part 3 extends outwardly of the casing 7 and a step seat 32 at the front side of the catch part 3 has a locating hole 33 with an extension spring 34 inside. The extension spring 34 at an end thereof urges against a stopper 75 of the casing 7. Further, a protrusion 35 extends laterally from the step seat 32 and the plate tenon 37 is provided on a bottom plate 36 of the step seat 32 corresponding to the protrusion 35 to be pressed by the press stem 13 so that the press stem 13 is not possible to be pressed backward and the lock hook 24 pressingly catches the plate tenon 37 such that the plate tenon is not possible to move upward.

The press button 4 extends inward two hook plates 41 and a spring 42 is attached to and surrounds the hook plates 41 before the press button 4 is inserted into a fitting hole 73, which is provided in the casing in advance, without loosening out. Besides, in order to enhance the smoothness during pressing and the reliability during assembling, the two hook plates 41 at the inner ends thereof project a guide tenon 43 respectively so as to be inserted into a guide groove 731 at a lateral side of the fitting hole 73. When the press part 1 is pressed backward, the two hook plates 41 at the end parts thereof are disposed against the lateral engaging projection 14 to keep the press part 1 in a state of being located in place and supplying burning gas.

The storage barrel 5 is hollow and provides a threaded hole at the top thereof to engage with a hollow screw rod 61 on the gas supply device 6 at the bottom thereof such that the burning gas can flow toward a conventional flow control valve 63 via a gas passage 62 as disclosed in U.S. Pat. No. 5,916,319. The burning gas can be regulated in a state of cutoff/admittance and the output amount thereof. The gas passing through the flow control valve 63 is blocked by an extensible control valve 64 received in the air passage 62 and the gas is not possible to be supplied to a gas jet part 65. As soon as the press part 1 is pressed down, the extensible control valve 64 and the piezo-electric apparatus 8 are pushed simultaneously to open the extensible control valve 64 such that the gas can enter the gas passage 62 through the extensible control valve 64. Finally, the gas can spray out from a conventional nozzle at the gas jet part 65 to mix with the air through an air hole. Then, the gas-air mixture is guided to the mouth of a flame projector (not shown) to be ignited by the spark of static electricity generated from the piezo-electric apparatus 8 such that the operation of combustion can be performed successfully. It is noted that the gas jet part 65 and the flame projector are conventional art and no detail will be described further.

Moreover, in order to avoid the gas supply device 6 and the storage barrel being detached by the user himself, a disk 66 above the screw rod 61 of the gas supply device 6 can provide a plurality of disk teeth 661 surrounding the periphery hereof to mesh with an inner gear ring part 521 of a locating plate 52. Then, the crew rod 61 engages with the threaded hole 51 afterward. When the locating plate 52 touches the top of the storage barrel 5 or is received in a barrel groove 53 with a shape identical with the locating plate 52 and fastened to the storage barrel 5 by way of screws. Hence, the disk teeth 661 are caught by the inner gear ring part 521 and the disk 5 is unable to turned any more.

Next, the storage barrel 5 is a plastic barrel made from injection molding and the lower part thereof is attached with a bottom cover 54 by way of being welded together with the supersonic wave. In order to prevent the bottom cover 54 from being detached from the storage barrel 5 caused by the high pressure of liquefied gas, at least two pin holes 55, which are provided on the lower rim of the barrel, align with cover grooves 56, which are provided on the bottom cover corresponding to the pin holes 55, and are passed through a locating pin 57 respectively before the treatment of the welding of supersonic wave.

The casing 7 is composed of a left casing part 71 and a right casing part 72, which joins to the left casing part 71 as a whole piece, and the preceding component parts are enclosed therein above the storage barrel 5. The respective inner wall surface of the left and the right casings 71, 72 has conventional tenons, ribs, grooves, and holes for the two casing parts being possible to be joined together and the gas supply device 6 being possible to be received in and fixedly attached to the casing 7. Besides, one of the casing parts 71, 72, such as the left casing part 71, can provide a button hole 73 for receiving and locating the press button 4. In addition, a plurality of rib plates 74 are attached to the casing 7 so that the press part 1 and the engaging part 2 are possible to slide and guided to the catch part 3. Furthermore, the stopper 75 above the catch part 3 is used for receiving and pressing the extension spring 34 of the catch part 3 such that each part in the casing 7 can be actuated more smoothly.

Referring to FIGS. 2 to 5, while the safety catch device for a gas burner according to the present invention is in use, the flow control valve 63 is opened first, and then the engaging part 2 is pressed down to move backward along the fixing seat 15 such that the lock hook 24 is separated from the plate tenon 37 to disarm the catch part 3 from the state of locking due to the lock hook 24 losing the function of pressingly catch. Meanwhile, the catch part 3 is pushed upward to urge the extension spring 34 such that the plate tenon 37 engages with the hook recess 241 to locate the catch part 3 and the upward movement is stopped. At this moment, the press stem 13 behind the press part 1 can be pressed and move to a position under the protrusion 35 to form a lap join over the protrusion 35 due to the protrusion 35 moving upward such that the catch part 3 can stay in place without moving downward. In the mean time, the extendible control valve 64 and the piezo-electric apparatus 8 are compressed simultaneously to admit the gas reaching to the flame projector through the extendible control valve 64 and the gas jet part 65 respectively. The gas sprayed out of the mouth on the flame projector can be ignited immediately by the spark generated from the piezo-electric apparatus 8 to carry out the operation of combustion. Thus, the flame can burn continuously as soon as the finger keeps to press the press part 1 to allow the extendible control valve in a state of opening.

In case of the combustion being carried out a long period of time, the press button 4 can be pressed down and the press part 1 is released to actuate the two hook plates 41 against the engaging projection 14 such that the press button 4 can be located in place to stop the press part 1 bouncing outward.

Figure 6:
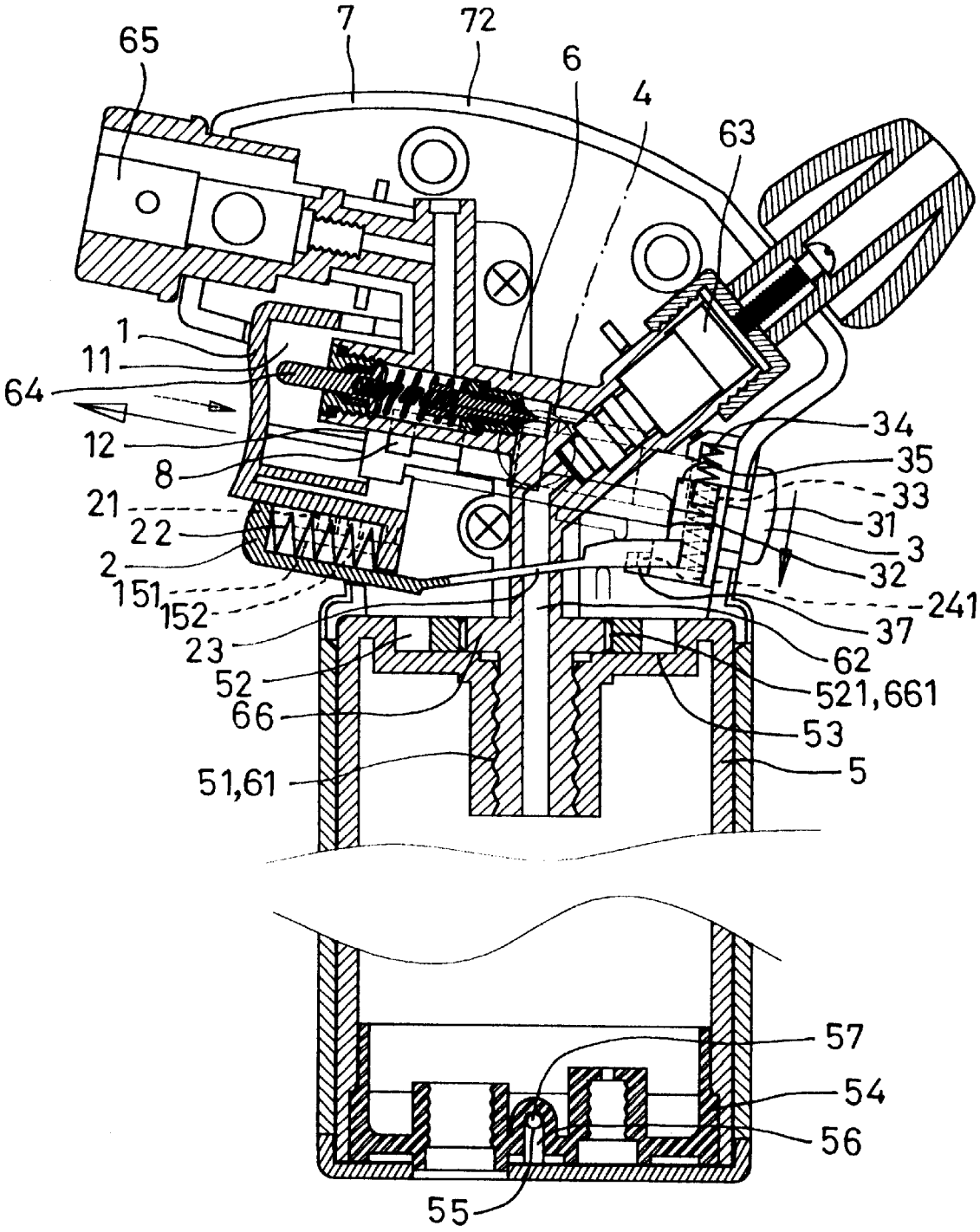
FIG. 6 is a sectional view illustrating a step of automatic locking operated by the safety catch device for a gas burner according to the present invention.

Referring to FIG. 6, when the burner is not in use, the press part 1 is pressed again to retreat the engaging projection 14 and the engaging part 2 slightly such that the plate tenon 37 and the lock hook 24 are in a state of lap joining together. The press button 4 can be restored to the original position thereof by way of the stretch of the spring 42 due to missing the lateral push force of the engaging projection 14. The press part 1 moves forward due to the rebound action of the piezo-electric apparatus so that the spring 22 between the fixing seat 15 and the engaging part 2 is urged and the protrusion 35 results in being not supported by the press stem 13 and the engaging part 2 is dragged out simultaneously. The catch part 3 moves downward to the original position thereof due to the stretch action of the extension spring 34 to separate the lock hook 24 from the plate tenon 37 and to be restored to the original position thereof by way of the stretch of the spring 22 as shown in FIG. 2 again.

It is appreciated that the engaging part and the press part of the present invention constitutes a doubly reliable switch to make the operation of the burner very much complicate and difficult so that it is capable of preventing an unexpected fatality derived from the careless play conducted by the children and fulfilling the safety regulations of U.S. and European countries. Furthermore, once the operation of combustion of the present invention is to be released, the only thing has to be done is simply to press down the press part and each locking element thereof can be restored to the original position to cut off the gas supply. In this way, the flame can be extinguished and the safety catch device can be in a state of locking so that the present invention provides a design full of humanization. Moreover, the parts of the present invention have been modularized so that it is very easy for the safety catch device of the present invention to be set up conveniently.

While the invention has been described with reference to a preferred embodiment thereof, it is to be understood that modifications or variations may be easily made without departing from the spirit of this invention, which is defined by the appended claims.

What is claimed is:

1. A safety catch for a gas burner having a gas supply device connected to a storage barrel, the gas supply device including a flow control valve, an extensible control valve, a gas jet and a piezoelectric apparatus, the safety catch comprising:

a) a casing covering the gas supply device;

b) a press element movably mounted on the casing and including a press chamber receiving a portion of the extensible control valve, a press tenon engaging the piezoelectric apparatus, an extending press stem with a lateral engaging projection and a fixing base on a bottom of the press element;

c) an engaging element mounted on the fixing base so as to be movable relative to the press element, the engaging element including a tilt lock plate with a lock hook; and, d) a catch element movably mounted on the casing so as to be movable between a locked position and an unlocked position, the catch element including a push key located exteriorly of the casing, a step seat with a lateral protrusion and a plate tenon spaced from the lateral protrusion, whereby, when the catch element is in the locked position, the lateral protrusion contacts the press stem thereby preventing movement of the press element which prevents opening of the extensible control valve and actuation of the piezoelectric apparatus, and engagement of the plate tenon with the lock hook on the engaging element prevents movement of the catch element from the locked position, and, when the engaging element is moved relative to the press element, the lock hook is disengaged from the plate tenon, enabling the catch element to be moved to the unlocked position thereby disengaging the lateral protrusion from the press stem enabling movement of the press element relative to the casing, such movement opening the extensible control valve and actuating the piezoelectric apparatus to ignite the gas burner.

2. The safety catch for a gas burner of claim 1 further comprising a press button having at least one hook plate and movably mounted in the casing so as to be movable between a released position and an engaged position in which the at least one hook plate engages the lateral engaging projection of the press element thereby holding the press element in an inward position.

3. The safety catch for a gas burner of claim 1 further comprising slide rails on a bottom of the fixing base forming rail grooves in which is movably mounted the engaging element.

4. The safety catch for a gas burner of claim 1 further comprising a plurality of side projections projecting from sides of the press element engaging rib plates on the casing so as to movably mount the press element on the casing.

5. The safety catch for a gas burner of claim 1 further comprising a spring acting between the fixing base and the engaging element.

6. The safety catch for a gas burner of claim 1 further comprising a spring acting between the catch element and the housing so as to bias the catch element toward the locked position.

7. The safety catch for a gas burner of claim 1 further comprising:

a) a disk on the gas supply device having a plurality of teeth on a periphery thereof; and, b) a locating plate mounted on the storage barrel and having an opening with an inner gear portion engaging the plurality of teeth on the disk.

8. The safety catch for a gas burner of claim 1 further comprising:

a) a bottom cover on a bottom of the storage barrel, the bottom cover having a cover groove;

b) a plurality of holes in the storage barrel aligned with the cover groove; and, c) a locating pin passing through the plurality of holes and the cover groove.

* * * * *